United States Patent [19]

Case

[11] Patent Number: 4,718,705

[45] Date of Patent: Jan. 12, 1988

[54] BIMETAL ACTUATED LOCK

[75] Inventor: Richard P. Case, Webster City, Iowa

[73] Assignee: White Consolidated Industries, Inc., Cleveland, Ohio

[21] Appl. No.: 899,862

[22] Filed: Aug. 25, 1986

[51] Int. Cl.[4] ..... E05B 17/22

[52] U.S. Cl. ..... 292/201; 292/DIG. 66; 292/DIG. 69; 292/336.3

[58] Field of Search ..... 292/96, 144, 201, DIG. 66, 292/DIG. 69, 336.3

[56] References Cited

U.S. PATENT DOCUMENTS

| | | | |
|---|---|---|---|
| 4,074,545 | 2/1978 | Case | 292/DIG. 69 |
| 4,179,907 | 12/1979 | Schantz | 292/DIG. 69 X |
| 4,286,811 | 9/1981 | Schantz | 292/201 |

*Primary Examiner*—Richard E. Moore

*Attorney, Agent, or Firm*—Pearne, Gordon, McCoy & Granger

[57] ABSTRACT

A door locking device for an appliance such as a washing machine has a rotatable lock lever actuated to engage a latch carried by the door to hold the door in a closed position. The lock lever is actuated by a bimetallic element which is adapted to be connected in series with the drive motor when the washing machine is in the spin condition so that the electric current passing through the drive motor passes through the bimetallic element and the resulting heating and deflection of the bimetallic element actuates the lock lever. The unit also carries an interlock switch actuated by the latch mechanism to prevent operation when the door is open. A shunt switch is provided to close electrical contacts when the bimetallic element and lock lever are deflected to the locked position to shunt current past the bimetallic member to prevent further heating and to insure a substantially constant unlock time.

10 Claims, 6 Drawing Figures

BIMETAL ACTUATED LOCK

BACKGROUND OF THE INVENTION

This invention relates generally to a bimetal actuated lock for a lid or door and more particularly is directed to a lock for the lid or door of a laundry appliance such as a washing machine where the lock is actuated automatically when the machine is in operation to prevent opening of the lid or door while the spin tub is rotating at a high rate of speed.

Washing machines, whether of the top loading or front loading type, have two general modes of operation. During the wash mode, the movement of the parts is generally at a rather slow speed to cause the relative movement of the clothes and the wash liquid, and at this speed no particular danger is likely to result if the lid or door were opened and the operator were to place a hand or other object inside the machine, since such machines have an electrical interlock which de-energizes the motor whenever the door or lid is opened. However, when such machines are in the spin cycle in which as much liquid is removed from the clothes as possible, the spin tub is rotating at a high rate of speed and with the load of wet clothes represents a relatively large magnitude of angular momentum. Under these conditions, if the lid or door is opened, the operation of an interlock switch to de-energize the motor is insufficient to bring the parts to a stop quickly and if a person were to reach into the machine under those conditions, severe injuries could result.

In view of this problem, two approaches have been used as a safety feature. One of these is to utilize a brake in the drive mechanism which is automatically actuated upon de-energization of the motor by the interlock to apply a positive braking action and bring the rotating spin tub to a halt as quickly as possible. However, the brake mechanism is rather expensive and subject to wear after an extended period of time, which tends to decrease its effectiveness and cause a longer period of time to elapse before the spin tub is completely stopped.

The other approach to solving this problem is to use a locking device to positively prevent the opening of the lid or door of the washing machine whenever the spin tub is rotating. This can be accomplished by the use of a solenoid-operated lock which positively engages the door as long as the solenoid is energized and then releases the door after the tub is stopped to allow access to the interior of the washing machine. It has been recognized that a solenoid-type locking device has shortcomings not only because of the high cost and reliability question of the solenoid itself but also the need to provide extra contacts on the timer to provide the necessary time delay after the motor has been de-energized for the spinning tub to come to a stop.

An alternative to the solenoid locking device has been proposed in the form of a lock which is actuated by a bimetallic element which is heated by the current passing through the drive motor. Such a device has been disclosed in the present inventor's U.S. Pat. No. 4,074,545 granted Feb. 21, 1978. A similar device is also shown in U. S. Pat. Nos. 4,179,907 and 4,286,811. With this locking arrangement, the high inrush current when the motor is energized causes a large current to flow through the bimetal element to rapidly heat it so that the latch blade will move rapidly into a locking condition. When the motor is de-energized, the thermal lag in such a device causes the locking blade to remain in the engaged position for a period of time for the bimetal element to cool off and the parameters of operation can be adjusted so that the blade remains in the locking position for a sufficient period of time for the spin basket to come to a complete stop. However, it has been recognized with this prior bimetal lock, that the parameters must be chosen such that it will actuate and heat to a temperature sufficiently high that cooling will take a long enough time that the lock will not disengage before the spin tub stops under any load conditions. Thus, the lock must be designed to work with a minimum load, and when the machine is used with a heavy load, particularly one that has a relatively high imbalance, the increased motor torque and hence current through the lock will tend to noticeably increase the unlocking time.

SUMMARY OF THE INVENTION

The present invention provides a lock mechanism in the form of a bimetallic electrothermal actuator to be positioned adjacent a door opening on an appliance such as a top loading washing machine, where the lock mechanism is placed directly underneath the top adjacent an edge of the door opposite from the side on which it is hinged. There is a small opening in the top through which a latch member carried by the cover extends when the door is in a closed position. The lock mechanism includes an interlock switch which is actuated by the latch member when the door is in the closed position to close the contacts of the normally open interlock switch, which prevents operation of the machine when the door is open. Normally, in a top loading washing machine, the lock mechanism is connected electrically through the programmed timer so that it is in series with the drive motor only when the motor is programmed to go into the spin mode. The interlock switch then acts to prevent energization of the motor in the spin mode except when the door is in the closed position. The door lock and interlock are normally not connected in the circuit by the timer when the washing machine is in an agitate mode or other portion of the cycle when access to the interior is not considered dangerous.

The lock mechanism includes a lock lever which is arranged to engage the latch member on the lid to positively prevent the lid from being open when the lock lever is engaged. Actuation of the lock lever is controlled by a bimetallic element which may generally be constructed and arranged as shown in the aforesaid U.S. Pat. No. 4,074,545. Thus, when the lid or cover is in the closed position with the interlock switch closed when the program timer goes into a spin mode, the drive motor is energized through the interlock switch and the bimetal element which is heated by its own resistance as the full current for the drive motor passes through it. Because of the high starting current of the drive motor, there is a high inrush current through the bimetallic element which allows it to heat up rather quickly and respond to provide the necessary movement so that the lock lever will engage the latch mechanism very quickly before the spin basket in the washing machine has accelerated to a high rate of speed.

When the lock lever reaches substantially full engagement with the latch member on the cover, movement of the lock lever closes a pair of switch contacts that are connected electrically across the bimetal element, thereby shunting or shorting out the bimetal element so that substantially no current passes therethrough. When this is done, the bimetal element is no longer heated by the current flowing through it and it will begin to cool down and tend to move the lock lever toward the unlocked position. However, before the lock lever moves any substantial distance, the shutting contacts are opened to allow full current to again pass through the bimetal element, thereby heating it up and moving the lock lever back toward the fully locked position. Thus, as long as the motor current is passing through the lock unit, as determined by the operation of the timer, the lock member will oscillate back and forth, in locking engagement with the latch member, with the shunting contacts continually opening and closing.

Although the shunt switch contacts may open and close cyclically all during the time that the washing machine is in the spin mode, and thus may be required to carry relatively high currents depending upon the load on the drive motor, the contacts operate at very low effective voltage. Because the bimetal element has a relatively low resistance, the voltage drop across this member will be insignificant as compared to the voltage applied to the drive motor. The fact that the shunt contacts carry a high current but at a low voltage minimizes any arcing at these contact points as they open and close, and thereby can provide relatively long life for the unit despite a high number of opening and closing cycles for the contacts.

As a result of the operation of the shunting contacts of this invention, the heating, and hence deflection, of the bimetal element is limited to a predetermined maximum regardless of the absolute value of the current passing through the drive motor. The construction and arrangement of the bimetallic element and the shunt contacts may thereby be selected for proper operation under the lowest drive motor run currents, and if such current is substantially increased because of a larger and perhaps highly unbalanced load in the spin tub, the unlocking time will remain constant since the deflection and temperature of the bimetal is limited by the operation of the shunting contacts.

DESCRIPTION OF THE PREFERRED EMBODIMENT

Figure 1:
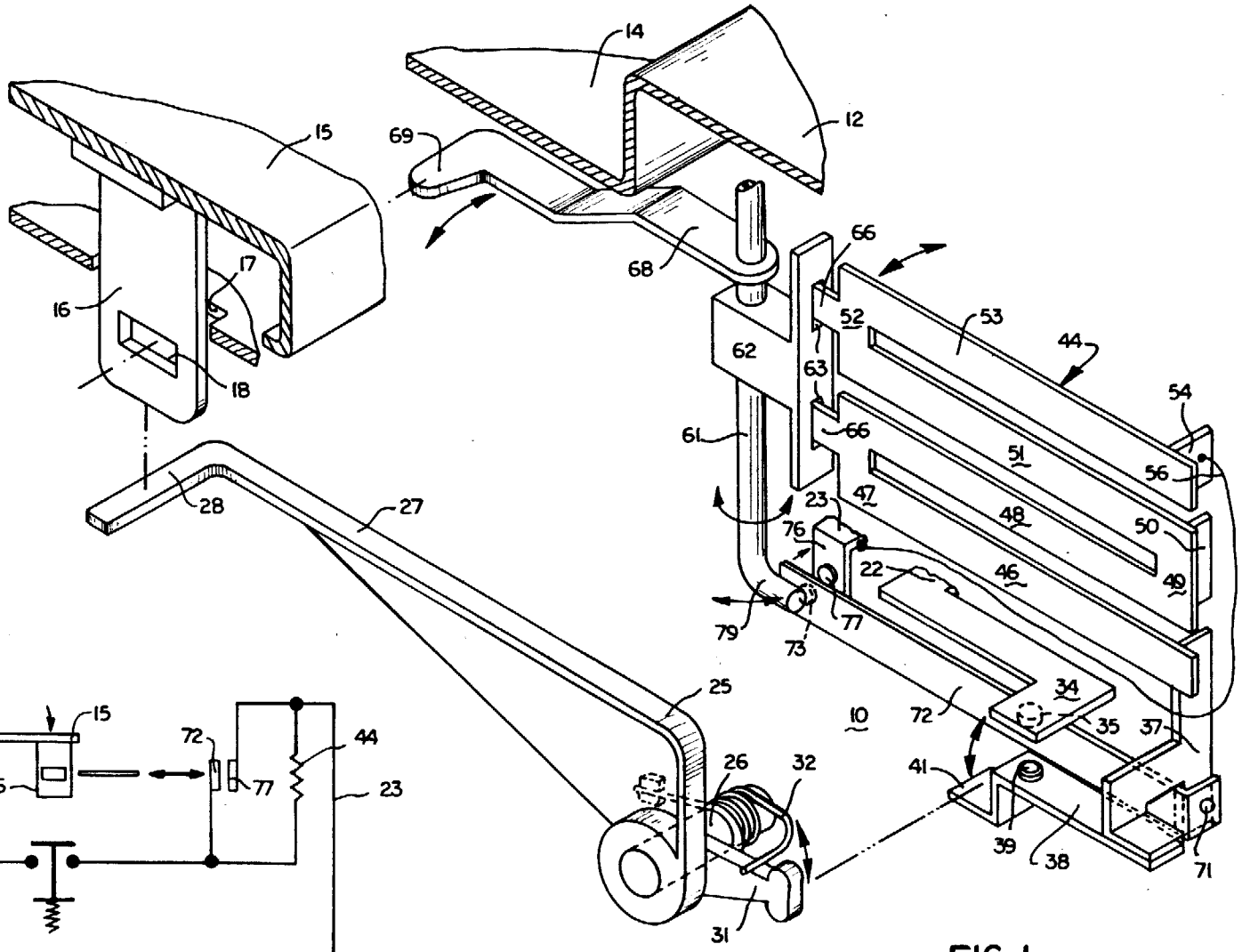
FIG. 1 is a fragmentary, exploded, perspective view of the lid lock according to the present invention as installed in a top loading washing machine.
Figure 6:
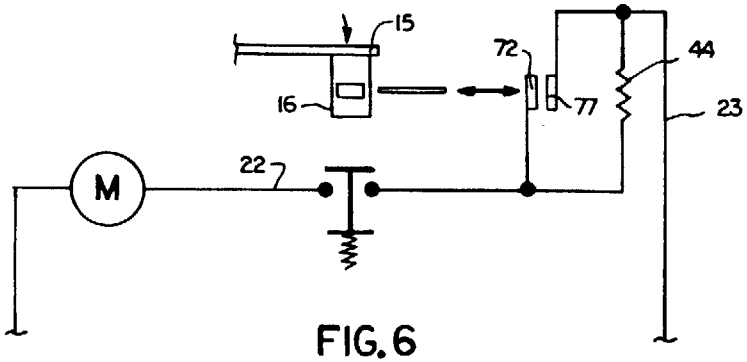
FIG. 6 is a fragmentary circuit diagram showing the operation of the shunt contacts of the lock mechanism.
Figure 2:
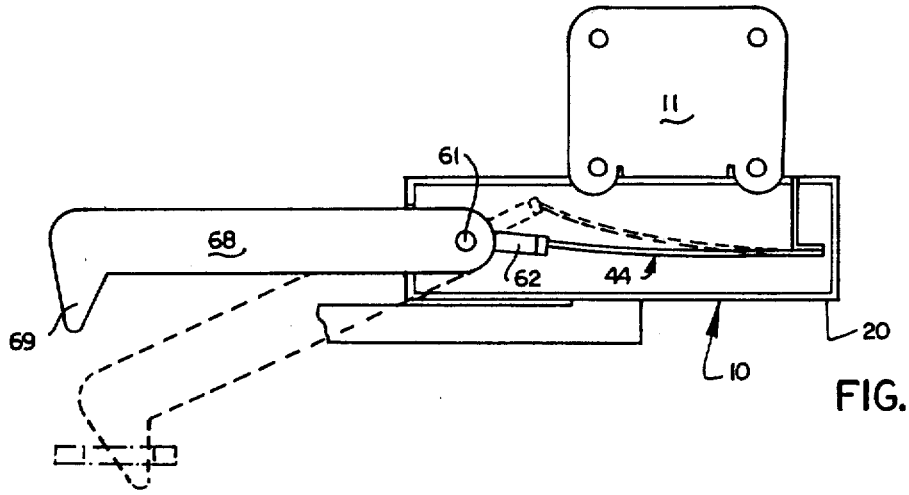
FIG. 2 is a top plan view, with parts broken away, of the lock mechanism of FIG. 1.
Figure 3:
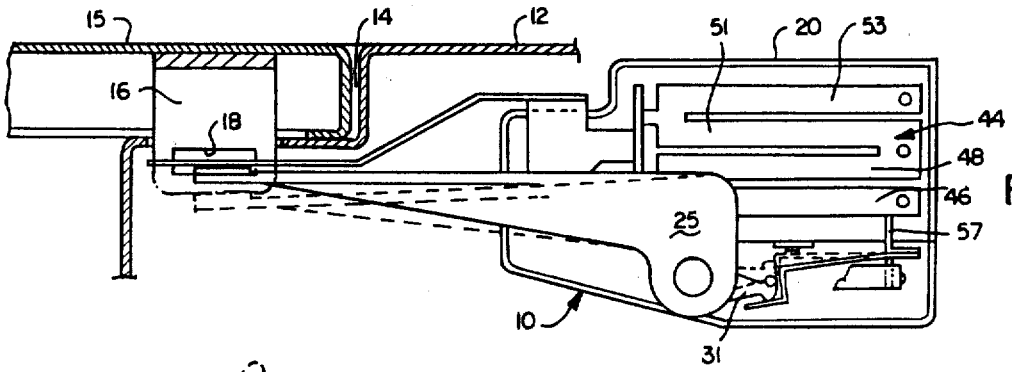
FIG. 3 is a side elevational view, with parts broken away, of the lock mechanism as installed in a washing machine.
Figure 4:
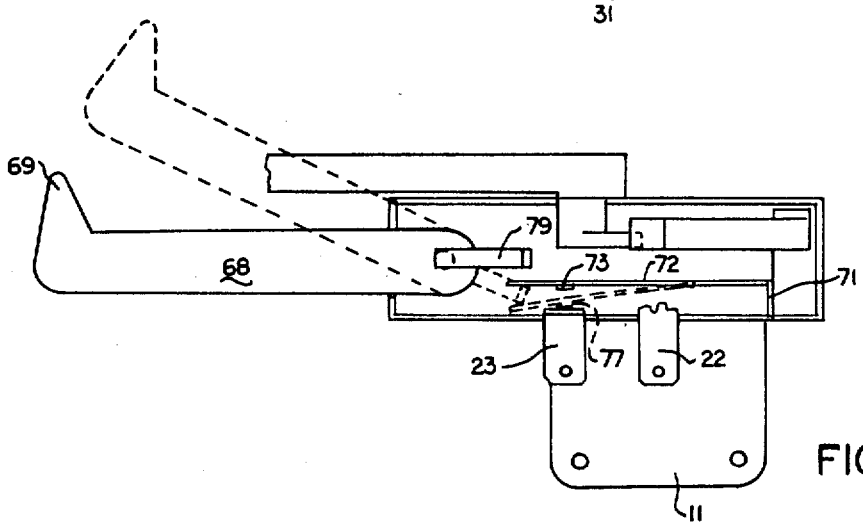
FIG. 4 is a bottom view of parts broken away of the lock mechanism.

Referring now to the drawings in greater detail, there is shown the lid lock 10 according to the preferred embodiment of the present invention. While the lid lock 10 can be used in a number of different applications, it is shown, for purposes of illustration only, as being particularly adapted to lock the lid or cover of a top loading automatic washing machine in the closed position while the machine is in a spin condition where the spin tub 19 rotating at a high rate of speed for centrifugal water extraction from the clothes. The lid lock 10 has an integral mounting flange 11 by which it is secured underneath the washing machine top panel 12 in a suitable manner. The top panel 12 has a recess 14 around the opening giving access to the spin tub and a hinged cover or lid 15 is mounted in the recess 14 by hinges (not shown) on the opposite side. Thus, the cover lid 15 can move upward or downward out of or into the recess 14 to close off the opening.

Attached to the underside of the lid 15 is a latch member 16, which, when the lid is in the closed position extends downward through an opening 17 in the recess 14. The latch member 16 in turn has an opening 18 at its lower end positioned so that when the lid 15 is in the closed position, the opening 18 on latch member 16 will be below the surface of the recess 14.

As shown in greater detail in FIGS. 2-5, the lid lock 10 is an electrothermal actuator which includes a suitable casing or frame 20 formed of an electrical insulating material. A pair of electrical terminals 22 and 23 project from the side of casing 20 beneath the mounting flange 11 and provide the electrical connection to the rest of the circuitry of the washing machine.

On the other side of casing 20 is mounted a switch lever 25 having a rotatable shaft 26 journalled in the casing 20 to rotate about an axis parallel with the top panel 12. The switch lever 25 also includes an arm 27 extending adjacent the opening 17 where it has a bent end portion 28 extending beneath opening 17, so that when the lid 15 is closed, the end of the latch member 16 will engage the bent end portion 28 to rotate the switch lever 25 in a downward direction. The shaft 26 extends through the interior of casing 20 where it includes a cam arm 31 extending in the opposite direction from the arm 27, and which serves to mount a coil-type biasing spring 32 which surrounds the shaft 6 and is anchored at one end to the casing 20 and at the other end to the cam arm 31 to bias the switch lever to a position where the arm is adjacent the top panel 12.

Within the casing 20, the one terminal 22 has a terminal extension 34 which extends above the cam arm 31 where it carries a contact 35 which is therefore rigidly mounted in position. Also mounted on casing 20 is a bracket member 37 on the lower end of which is mounted a flexible contact arm 38 which extends adjacent the terminal extension 34. On contact arm 38 is mounted a contact button 39 adapted to make electrical contact with the contact button 35 on terminal extension 34. The contact arm 38 extends beyond contact 39 to form an offset portion 41 extending underneath the cam arm 31. The flexible contact arm 38 is normally biased so that the contacts 35 and 39 are in electrical contact to make continuity therethrough. However, the biasing force of bias spring 32 is sufficient to rotate the shaft 26 so that the switch lever arm 27 is moved to a raised position and the cam arm 31 engages the offset portion 41 so as to move the flexible contact arm 38 downward with contact 39 out of engagement with the other contact 35. However, when the lid is closed, the latch member 16, because of the weight of the lid, forces the end portion 28 and arm 27 downward against the force of bias spring 32 so that the cam arm 31 rises and allows the natural resiliency of contact arm 38 to bring the contacts 39 and 35 into engagement.

Figure 5:
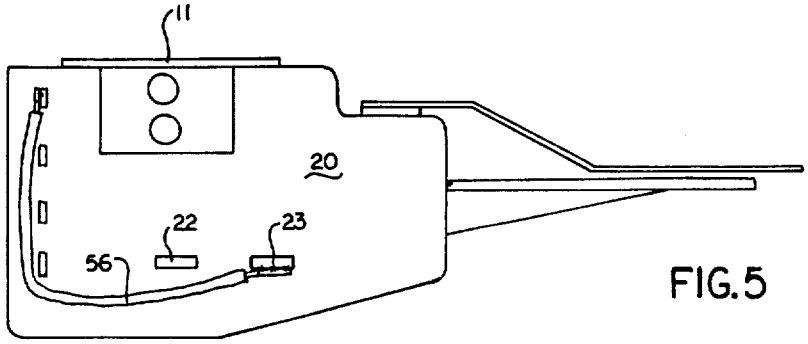
FIG. 5 is a side elevational view of the lock mechanism opposite from that of FIG. 3.

A bimetal element 44 is mounted in the casing 20 to lie in a substantially vertical plane and is anchored to the casing 20 at the end away from latch member 16. The bimetal element 44 consists of a plurality of parallel extending legs arranged to provide a continuous current path to provide for uniform heating, and hence uniform deflection, of all of the legs together. Thus, a first leg 46 is secured to the bracket 37 and a first end 47 at the opposite end is connected to a second leg 48 extending back to a base portion 49 secured to a mounting lug 50 carried on the casing 20. A third leg 51 extends from the lug 50 to terminate in a second end 52 connected to a fourth leg 53 which extends back to a terminal lug 54 carried on the casing 20. As shown in FIG. 5, the electrical circuit is completed by an external wire 56 on the outside of casing 20 extending from the terminal lug 54 back to the other terminal 23. From this it will be seen that when the switch lever 25 is depressed by the latch member 16, there will be electrical continuity from the one terminal 22 through the contacts 35 and 39 to the bimetal element, where the current in turn passes through the first, second, third and fourth legs to the terminal lug 54 and hence back to the other terminal 23. When the current passes through the terminals the bimetal element will then be heated and the first and second ends 47 and 52 will then be heated and the first and second ends 47 and 52 will then be deflected in a direction toward the side of the casing 20 carrying the terminals 22 and 23.

To provide the locking action as a result of the deflection of the bimetal element 44, a vertical shaft 61 is rotatably journalled in the casing 20 and secured thereto is a pivot block 62 rotatable with the shaft 61. The pivot block 62 has a pair of vertically spaced recesses 63 adapted to receive projecting fingers 66 on the bimetal ends 47 and 53. Thus, deflection of the bimetal element through the connection of the pivot block 62 will cause the vertical shaft 61 to rotate. Accordingly, a locking lever 68 is carried on the upper end of shaft 61 outside of the casing 20 and projects toward the latch member 16, where it carries a projecting tip 69 adapted to move into the opening 18 to prevent opening of the cover. Thus, when the bimetal element is in the unheated condition, the legs will be undeflected and the locking lever will be in a position where the tip 69 is spaced away from the latch member. However, when the cover is closed and the electric motor is energized to cause current to flow through the bimetal element, the lever 68 will be rapidly deflected so that the tip 69 enters the opening 18 and by interconnection between the locking lever 68 and the underside of the top panel 12, it is not possible to raise the cover 15 as long as the tip 69 is in locking position.

As explained hereinabove, the construction of the bimetal element must be such that under a minimal load condition when there is a minimal current through the drive motor, the bimetal element must be heated by that current to assume a sufficient deflection that the tip 69 will enter the locking opening 18 on latch member 16. Since the motor operates from a stopped condition at the start of a spin cycle, there will be a high starting current and the bimetal element 44 will be heated with sufficient rapidity, in the order of one or two seconds, for the locking tip 69 to engage the latch member. The problem encountered with prior art devices, however, is that in the event that the running current for the motor is quite high, there will be a tendency for the bimetal element, as a result of the continued flow of such higher current, to be deflected more than the optimum amount. Although the locking lever 68 is limited in its range of movement, once the tip 69 enters opening 18, the bimetal element will flex further under the higher current. When the spin cycle ends and current flow stops, this additional heating and flexing of the bimetal results in a longer unlock time.

The present invention overcomes this problem by providing a shunt switch arrangement which shorts out the bimetallic element whenever the tip 69 is in full engagement with the opening 18. To accomplish this, a flexible electric contact arm 72 is mounted at one end on a depending leg 71 which is an integral part of bracket 37. The contact arm 72 extends adjacent the vertical shaft 61 where it carries a contact 73 on the side facing the casing side 20 on which the terminal 22 and 23 are mounted. Accordingly, terminal 23 has a downwardly extending extension 76 on the inside of casing 20 which carries an electrical contact 77 in alignment with the contact 73. A projecting arm 79 carried on vertical shaft 61 at the lower end is so positioned that when the vertical shaft 61 is rotated to a position where the blocking lever tip 69 is in full engagement with the opening 18, the contact 73 on contact arm 72 will be moved into engagement with the contact 77. This in effect provides a shunt or direct short across the bimetal element which, even though the value is quite low to allow high currents with a minimum voltage drop, has a certain amount of electrical resistance. Thus, a direct short across the bimetal element will drop the current flow through the bimetal element to a miminum so that the element will no longer be effectively heated. When this occurs, the bimetal element begins to cool and tends to return to its normal position, thereby tending to withdraw the locking lever tip 69 from the opening 18. However, the contacts 73 and 74 are so positioned that they will disengage almost at once before there is any substantial movement of the locking lever 68, with the result that the bimetal element will no longer be shorted and current will again pass through the bimetal element to heat it and tend to move the locking lever 68 in the locking direction.

It will be seen that during the spin cycle the shorting effect through the contacts 73 and 77 will tend to have a cycling effect with an oscillating movement with the locking lever 68. However, the magnitude of this movement is quite small and does not have any substantial effect on the position of the locking lever. Thus, when the spin cycle ends, the bimetal will always, regardless of the value of the current, be at substantially the same temperature and position, so that the unlocking time is substantially constant. While the contacts 73 and 77 are thus required to open and close under a relatively small amount of physical movement while the lid lock is actuated, the voltage drop across those contacts is minimal so that there is substantially no arcing effect and the contacts will have a long service life.

It is noted that the bimetal element 44 as shown and described is arranged to have four legs to provide sufficient actuating force. It is recognized that one pair of legs could be eliminated and the bimetal element be in the form of an inverted U with the free legs anchored on the base.

Although the preferred embodiment of this invention has been shown and described, it should be understood that various modifications and rearrangements of the parts may be resorted to without departing from the scope of the invention as disclosed and claimed herein.

What is claimed is:

1. A safety interlock for a door of an appliance or the like comprising: a door movable between open and closed positions, a frame member, a lock mechanism mounted on said frame member, said lock mechanism including a bimetallic element having first and second ends, said bimetallic element being fixed at said first end to said frame member and carrying lock means at said second end, said bimetallic element, upon application of heat thereto, being movable to move said lock means, latch means carried by said door, said latch means having a notch therein positioned when the door is closed to be engageable by said lock means upon application of heat to said bimetallic element, means to supply an electric current through said bimetallic element to heat it, and shunt means in parallel with said bimetallic element, said shunt means including switch means operable when said lock means moves a predetermined distance towards said latch means to cause at least part of said electric current to bypass said bimetallic element and thereby reduce the heating effect of said electric current.

2. A safety interlock as set forth in claim 1 wherein said lock means includes a lock lever rotatably mounted on said frame.

3. A safety interlock as set forth in claim 2 wherein said shunt means includes first and second electrical contacts connected to opposite electrical ends of said bimetallic element whereby closing of said contacts shorts out said bimetallic element.

4. A safety interlock as set forth in claim 3 including actuating means carried by said lock lever operable to close said electrical contacts after a determined movement of lock lever toward said latch means.

5. A safety interlock as set forth in claim 4, wherein said actuating means is structured to permit said contacts to open after a predetermined cooling of said bimetallic element and predetermined movement of said lock lever away from said latch means while remaining in locking engagement therewith.

6. A safety interlock as set forth in claim 5, wherein said interlock includes normally opened interlock switch means in series with said bimetallic element closeable by said latch means when said door is in the closed position.

7. An electrothermal actuator comprising a frame, a bimetallic member having at least first and second legs, said legs being connected each at one pair of adjacent ends to said frame, said legs being connected at the other ends to each other, a first terminal on said frame connected to said one end of said first leg, a second terminal on said frame connected to said one end of said leg, whereby an electric current passes from one terminal to the other terminal through said legs to heat said bimetallic member and cause deflection of said other ends, a normally open shunt switch on said frame connected between said first and second terminals, and means responsive to a predetermined deflection of said other ends to close said shunt switch to prevent further electric heating of said bimetallic elements while maintaining electrical continuity between said terminals.

8. An electrothermal actuator is set forth in claim 7 including a shaft member rotatably journalled in said frame and engageable by said other ends of said legs whereby deflection of said legs rotates said shaft member.

9. An electrothermal actuator is set forth in Claim 8 including actuating means carried by said shaft member to operate said shunt switch.

10. An electrothermal actuator as set forth in Claim 9, wherein said shunt switch comprises a fixed contact carried on said frame and a resiliently mounted, normally open contact engageable by said actuator means.

* * * * *

UNITED STATES PATENT AND TRADEMARK OFFICE

CERTIFICATE OF CORRECTION

PATENT NO. : 4,718,705

DATED : January 12, 1988

INVENTOR(S) : Richard P. Case

It is certified that error appears in the above-identified patent and that said Letters Patent is hereby corrected as shown below:

Column 3, line 5, "shutting"
should be --shunting--

Column 3, line 67, "19"
should be --is--

Column 5, lines 22 and 23,
delete "will then be heated and the first and second ends 47 and 52"

Column 5, line 32, "53"
should be --52--

Signed and Sealed this

Twenty-first Day of June, 1988

*Attest:*

*Attesting Officer*

DONALD J. QUIGG

*Commissioner of Patents and Trademarks*